US008920905B2

(12) United States Patent
Sauter et al.

(10) Patent No.: US 8,920,905 B2
(45) Date of Patent: Dec. 30, 2014

(54) FIBROUS PRODUCT WITH A RASTERED EMBOSSING AND METHOD FOR PRODUCING SAME

(75) Inventors: Jurgen Sauter, Mannheim (DE); Philippe Albouze, Aveze (FR)

(73) Assignee: SCA Hygiene Products AB, Gothenburg (SE)

( * ) Notice: Subject to any disclaimer, the term of this patent is extended or adjusted under 35 U.S.C. 154(b) by 584 days.

(21) Appl. No.: 13/128,916

(22) PCT Filed: Dec. 9, 2008

(86) PCT No.: PCT/EP2008/067113

§ 371 (c)(1), (2), (4) Date: May 12, 2011

(87) PCT Pub. No.: WO2010/066284

PCT Pub. Date: Jun. 17, 2010

(65) Prior Publication Data

US 2011/0223381 A1 Sep. 15, 2011

(51) Int. Cl.

| | |
|---|---|
| ***B32B 3/00*** | (2006.01) |
| ***B31F 1/07*** | (2006.01) |
| ***D21H 19/66*** | (2006.01) |
| ***D21H 19/74*** | (2006.01) |

(52) U.S. Cl.

CPC ..... *B31F 1/07* (2013.01); *B31F 2201/0733* (2013.01); *B31F 2201/0761* (2013.01); *B31F 2201/0792* (2013.01)

USPC ..... 428/156; 428/153; 428/212; 428/207; 428/211.1; 162/109; 162/134; 156/209; 156/277

(58) Field of Classification Search

CPC ..... B31F 1/07; B31F 2201/0733; B31F 2201/0761; B31F 2201/0792; D21H 5/02; D21H 19/68; D21H 19/74; D21H 27/02; D21F 11/006

USPC ..... 428/153, 166, 172, 212, 156, 207, 428/211.1; 162/109, 134; 156/209, 277

See application file for complete search history.

(56) References Cited

U.S. PATENT DOCUMENTS

| | | | |
|---|---|---|---|
| 6,235,373 | B1 | 5/2001 | Graff |
| 6,520,330 | B1 | 2/2003 | Batra |

(Continued)

FOREIGN PATENT DOCUMENTS

| | | | |
|---|---|---|---|
| DE | 10 2006 010 709 | A1 | 9/2007 |
| EP | 0 738 588 | A1 | 10/1996 |

(Continued)

OTHER PUBLICATIONS

International Search Report, dated Jan. 12, 2010, from corresponding PCT application.

*Primary Examiner* — Donald J Loney

(74) *Attorney, Agent, or Firm* — Buchanan Ingersoll & Rooney P.C.

(57) ABSTRACT

A fibrous product (10, 20, 20*b*, 30), especially tissue paper product, non-woven products or a hybrid thereof, and preferably hygiene and cleaning product has at least one first ply (42; 62; 84; 104) with at least one embossing pattern including embossed depressions starting from a base plane of the ply; the embossed pattern being characterized by the following features: the embossing pattern has a minimum motive surface area of at least 3 cm×3 cm; the pattern includes a high number of embossed depressions which are sized and/or positioned such as to form a motive element covering the motive surface area; wherein at least some of the embossed depressions are sized and/or positioned such that minimum distances between pairs of consecutively arranged embossed depression vary. A method for producing such a fibrous product is also described.

20 Claims, 10 Drawing Sheets

(56) References Cited

U.S. PATENT DOCUMENTS

| | | | | |
|---|---|---|---|---|
| 6,916,403 | B2 * | 7/2005 | Basler et al. | 162/117 |
| D529,295 | S * | 10/2006 | Kressner et al. | D5/57 |
| 2003/0021953 | A1 * | 1/2003 | Graff | 428/153 |
| 2003/0102096 | A1 | 6/2003 | Dwiggins et al. | |
| 2003/0118782 | A1 | 6/2003 | Graff | |
| 2005/0231813 | A1 | 10/2005 | Rostalski et al. | |
| 2007/0092700 | A1 | 4/2007 | Maddaleni et al. | |
| 2008/0020180 | A1 | 1/2008 | Graff | |
| 2009/0226670 | A1 | 9/2009 | Schutz | |

FOREIGN PATENT DOCUMENTS

| | | | |
|---|---|---|---|
| EP | 1 033 240 | A1 | 9/2000 |
| EP | 1 209 289 | A1 | 5/2002 |
| EP | 1 253 242 | A2 | 10/2002 |
| EP | 1 772 257 | A2 | 4/2007 |
| WO | 02/103112 | A1 | 12/2002 |
| WO | 2004/065113 | A1 | 8/2004 |
| WO | 2006/099881 | A1 | 9/2006 |
| WO | 2006/136186 | A1 | 12/2006 |
| WO | 2007/016941 | A1 | 2/2007 |

* cited by examiner (a)

(b)

(c)

FIBROUS PRODUCT WITH A RASTERED EMBOSSING AND METHOD FOR PRODUCING SAME

FIELD OF THE INVENTION

The invention relates to a fibrous product, especially tissue paper product, non-woven product or a hybrid thereof, and preferably hygiene and cleaning product with the pre-characterizing features discussed herein. The invention also relates to a method for producing such a fibrous product.

BACKGROUND OF THE INVENTION AND PRIOR ART

Hygiene or wiping products primarily include all kinds of dry-creped tissue paper, wet-creped paper, TAD-paper (Through Air Drying) and cellulose or pulp-wadding or all kinds of non-wovens, or combinations, laminates or mixtures thereof. Typical properties of these hygiene and wiping products include the reliability to absorb tensile stress energy, their drapability, good textile-like flexibility, properties which are frequently referred to as bulk softness, a higher surface softness and a high specific volume with a perceptible thickness. A liquid absorbency as high as possible and, depending on the application, a suitable wet and dry strength as well as an appealable visual appearance of the outer product's surface are desired. These properties, among others, allow these hygiene and wiping products to be used, for example, as cleaning wipes such as paper or non-woven wipes, windscreen cleaning wipes, industrial wipes, kitchen paper or the like; as sanitary products such as for example bathroom tissue, paper or non-woven handkerchiefs, household towels, towels and the like; as cosmetic wipes such as for example facials and as serviettes or napkins, just to mention some of the products that can be used. Furthermore, the hygiene and wiping products can be dry, moist, wet, printed or pretreated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, remove dust, for decorative purposes, for wrapping or even just as supporting material, as is common for example in medical practices or in hospitals.

If tissue paper is to be made out of pulp, the process essentially comprises a forming that includes a box and a forming wire portion, and a drying portion (either through air drying or conventional drying on a yankee cylinder). The production process also usually includes the crepe process essential for tissues and, finally, typically a monitoring and winding area.

Paper can be formed by placing the fibers, in an oriented or random manner, on one or between two continuously revolving wires of a paper making machine while simultaneously removing the main quantity of water of dilution until dry-solids contents of usually between 12 and 35% are obtained.

Drying the formed primary fibrous web occurs in one or more steps by mechanical and thermal means until a final dry-solids content of usually about 93 to 97% has been reached. In case of tissue making, this stage is followed by the crepe process which crucially influences the properties of the finished tissue product in conventional processes. The conventional dry crepe process involves creping on a usually 4.0 to 6.5 m diameter drying cylinder, the so-called yankee cylinder, by means of a crepe doctor with the aforementioned final dry-solids content of the raw tissue paper. Wet creping can be used as well, if lower demands are made of the tissue quality. The creped, finally dry raw tissue paper, the so-called base tissue, is then available for further processing into the paper product for a tissue paper product.

Instead of the conventional tissue making process described above, the use of a modified technique is possible in which an improvement in specific volume is achieved by a special kind of drying which leads to an improvement in the bulk softness of the tissue paper. This process, which exists in a variety of subtypes, is termed the TAD (Through Air Drying) technique. It is characterized by the fact that the "primary" fibrous web that leaves the forming and sheet making stage is pre-dried to a dry-solids content of about 80% before final contact drying on the yankee cylinder by blowing hot air through the fibrous web. The fibrous web is supported by an air-permeable wire or belt or TAD-fabric and during its transport is guided over the surface of an air-permeable rotating cylinder drum, the so-called TAD-cylinder. Structuring the supporting wire or belt makes it possible to produce any pattern of compressed zones broken up by deformation in the moist state, also named moulding, resulting in increased mean specific volumes and consequently leading to an increase of bulk softness without decisively decreasing the strength of the fibrous web.

To produce multi-ply tissue paper products, such as handkerchiefs, bathroom paper, towels or household towels, an intermediate step often occurs with so-called doubling in which the base tissue in the desired number of plies is usually gathered on a common multi-ply mother reel.

The processing steps from the base tissue that has already been optionally wound up in several plies are used in processing machines (converting machines) which include operations such as unwinding the base tissue, repeated smoothing of the tissue, printing, embossing, to an extent combined with full area and/or local application of adhesive to produce ply adhesion of the individual plies to be combined together as well as longitudinal cut, folding, cross cut, placement and bringing together a plurality of individual tissues and their packaging as well as bringing them together to form larger surrounding packaging or bundles. Such processing steps may also include application of substances like scents, lotions, softeners or other chemical additives. The individual paper ply webs can also be pre-embossed and then combined in a nip of rolls according to the embossing methods known in the art. Any embossing can lead to embossed elements all having the same height or to embossing elements having different heights. Ply bonding, e.g. by mechanical or by chemical means are other well-known methods mainly used for hankies, napkins and bathroom tissues and household towels.

A well-known technique to increase the thickness of a paper product is to emboss the paper web. An embossing process is carried out in the nip between an embossing roll and an anvil roll. The embossing roll can have protrusions on its circumferential surface leading to so-called embossed depressions in the paper web or it can have depressions in its circumferential surface leading to so-called embossed protrusions in the paper web.

Anvil rolls may be softer than the corresponding embossing roll and may consist of rubber, such as natural rubber, or plastic materials, paper or steel.

For manufacturing multi-ply tissue products, especially bathroom tissue and household tissue, three main manufacturing methods for embossing and adhesively bonding of the plies have established. These are Goffra Incolla/spot embossing, DESL (Double Embossing Single Lamination)/Nested, and Pin-to-Pin/Foot-to-Foot.

In the first mentioned manufacturing method, Goffra Incolla, a first web is directed through the nip between an embossing roll and an anvil roll. In this nip the web is provided with an embossing pattern. Thereafter, an application roll for adhesive applies adhesive to those parts of the first web at which there are protruding embossing elements in the embossing roll. The adhesive is transported from an adhesive bath via an adhesive transfer roll to the application roll. A second web is transported to the first web and adhesively bonded to the first web in the nip between the so-called marrying roll and the embossing roll. The adhesive bonding takes place at those portions at which the adhesive was applied.

The second manufacturing method (DESL/Nested) is very similar to the above-described Goffra Incolla method. It comprises an additional pair of rolls consisting of a second embossing roll and a second anvil roll. The additional pair of rolls serves to emboss the second web before it is adhesively bonded to the first web using the marrying roll. Typically, the additional pair of rolls is placed close to the first pair of rolls and the marrying roll. Especially when using the so-called Nested-method such close arrangement is important. The Nested-method can be considered as a special case of the general DESL-manufacturing method. For the Nested-method the embossing elements of the first embossing roll and the embossing elements of the second embossing roll are arranged such that the embossed elements of the first embossed ply and the embossed elements of the second embossed ply fit into each other similar to a gearing system. This serves to achieve a mutual stabilization of the two plies. However, for the DESL manufacturing method such correlation between the embossed elements of the first, upper ply and the second, lower ply, does not have to apply. Nevertheless, in a literature the term DESL is often used synonymous to a Nested-method.

The third manufacturing method (Pin-to-Pin/Foot-to-Foot) is similar to the DESL method. By means of two pairs of rolls both the upper ply and the lower ply are embossed, respectively. Adhesive is applied onto the embossed protrusions of the first ply. The ply bonding however, is not achieved by means of a marrying roll as in the DESL method but is achieved directly by means of the protruding embossing elements of the second embossing roll. In order to achieve this, an exact adjustment of the width of the gap between the first embossing roll and the second embossing roll is required, which is mainly defined by the individual thickness of both webs (upper ply and lower ply). Further, the embossing rolls have to be designed such that at least some of the protruding embossing elements of both rolls face each other. This is the reason why the terminology Pin-to-Pin or Foot-to-Foot embossing is used.

All above described methods have the following common features: the first embossing roll is formed of a hard material, usually metal, especially steel, but there are also known embossing rolls made of hard rubber or hard plastics materials. The embossing rolls can be a male roll having individual protrusions. Alternatively, the embossing roll can be a female roll with individual embossing depressions. Typical depths of the engraved embossing patterns are between 0.4 mm and 2.0 mm.

The anvil roll typically has a rubber coating. However, structurized anvil rolls, especially rolls made of paper, rubber or plastics materials or steel are also known.

The applicator roll for adhesive is usually also a rubber roll with a plain smooth circumferential surface, wherein the hardness of the rubber coating is between the hardness of the anvil roll and the hardness of the marrying roll. Commonly used values for the hardness of the rubber coating are 70 to 85 Shore A. When selecting the rubber material its compatibility with the adhesive to be applied has to be ensured.

The application system for adhesive consisting of applicator roll, adhesive transfer roll and adhesive bath can be designed as a so-called immersion roll system in which the adhesive transfer roll is immersed into the adhesive bath and transports adhesive by means of surface tension and adhesive forces out of the adhesive bath. By adjusting the gap between the adhesive transfer roll and the applicator or application roll, the amount of adhesive to be applied can be adjusted. Application rolls may be structured rolls. Further, adhesive transfer rolls have become known having defined pit-shaped depressions in their circumferential surface. Such adhesive transfer rolls are known as anilox-rolls. Such roll is usually made of ceramic material or it is a roll made of steel or copper and coated with chromium. Excessive adhesive is removed from the surface of the anilox-roll by means of a blade. The amount of adhesive is determined by the volume and the number of depressions. Alternative application systems for applying adhesives are based on a spraying equipment (e.g. Weko-technique).

A second possibility to influence the amount of adhesive transferred is the adjustment of the difference in circumferential speeds of the adhesive transfer roll and the applicator roll. Typically, the adhesive transfer roll rotates slower than the applicator roll. The circumferential speed of the adhesive transfer roll is usually between 5% and 100% of the first circumferential speed of the applicator roll. The adhesive bath can be designed as a simple trough, application systems with a blade can also be designed as chamber systems.

The embossing technologies Goffra Incolla/spot embossing and DESL/Nested, both use an additional roll, the so-called marrying roll for laminating together the plies. The marrying roll commonly has a smooth rubber surface with a hardness of about 90-95 Shore A. A suitable material is e.g. NBR (acrylnitrile-butadien rubber). However, marrying rolls also have become known which, in addition to the rubber coating, are provided with a steel coating. Such steel coating is often provided in form of a steel band spirally wound onto the rubber coating as described in WO2004/065113.

In case that the single layers individually or together are pre-embossed, a so-called micro-pre-embossing device is used. Such pre-embossing device is often used in combination with the Goffra Incolla technology. Also commonly used is a printing onto the tissue product before or after the ply bonding step. Also known are variants including the application of chemical substances, especially lotions and softeners.

Another well-known embossing technique comprises a steel embossing roll and a corresponding anvil steel roll (so-called Union embossing). The surfaces of these rolls are being formed in such a manner that deformation of the paper and mechanical ply bonding without using adhesives are achieved within one single embossing step.

When using one of the above described three embossing methods but also for a pin-to-pin technique it is advantageous to provide a control for the tension of the web both before and after the ply bonding because the physical properties of the web and especially the stress-strain characteristic can be changed significantly in the embossing step.

The embossing rolls used in the prior art are mainly manufactured using the so-called moletage technique which is a roll engraving by means of a cold forming of the steel of the embossing roll. According to such moletage technique, usually several cold forming steps and several etching steps have to be carried out. This known production technique places some limitations on the shape of the protrusions in the surface of the roll.

The flank angle has an impact on the mechanical stability of the paper product produced with such an embossing roll. If the flank angle is small, the product has a reduced local stability around the embossed structure because locally the fiber structure is destroyed to a large extent. Therefore, for reasons of a sufficient mechanical stability of the paper product and of the constraint put upon the manufacture of protrusions on the surface of the roll using the moletage technique, a flank angle of at least about 23° is commonly used in the art. The flank angle is measured against the vertical line on the circumferential surface of the embossing roll.

Another engraving technology for manufacturing embossing rolls for the tissue and hygiene industry is etching. Within a first step, a mask is applied on the circumferential surface of the embossing roll followed by a second step in which the surface is etched by applying acid at those areas where no mask has been applied. The result is a circumferential surface of the roll which is partly engraved, wherein the transition between engraved areas and non-engraved areas usually has a step angle of 0° up to 10°. In other words, the etching technique leads to a step-like surface structure. The steps of masking and etching with the same or different geometries of masks can be repeated several times. By using a repeated etching technique, a surface structure can be achieved which is similar to discrete stairs which extend from the original circumferential surface of the roll into the material of the roll.

A further technique for manufacturing embossing rolls for the tissue and hygiene industry is CNC milling. This technique is often used for simpler rectangular elements, for example truncated pyramids. The angle of the embossing elements and the radial direction of the embossing roll can be easily varied in a wide range if such angle is the same for all embossing elements.

Another technique predominantly used for rolls made of plastics material, like rubber rolls, is the use of a laser ablation technique. Laser techniques are used for rolls made of plastic material as well as for steel rolls. Other manufacturing methods for embossing rolls are manually engraving techniques or galvano-forming. In principle a combination of such techniques can be used for manufacturing embossing rolls. One preferred manufacturing process is based on masking/etching technology in combination with moletage. Another well-known combination of engraving techniques is a multi-step etching technique with at least four, preferably around eight separate etching steps, and the final rounding of the resulting steps in order to achieve a smooth shape of the embossing elements produced. Useful rounding steps are brushing with metal brushes, short overall etching or blast treatment with hard particles, such as glass, sand or corundium.

The embossing not only serves to provide bulk to the fibrous product but also to provide an improved optical appearance to the product. The optical appearance of a product is important for consumer products and also serves to provide a higher degree of recognition to the product. The optical appearance can be improved by combining embossing and coloring steps. Another reason for embossing is to generate higher absorbency or improved perceived softness.

In the prior art, different embossing techniques have been used to achieve a desired visual effect in embossing patterns. One possibility is to define specific regions in an embossed product in which the dot densities, i.e. the distances between individual, equidistantly arranged embossing spots are different to those of adjacent regions. One example of such prior art is US 2005/0231813 disclosing regions in which the point densities of embossed protrusions are different in order to generate a visual effect.

Another possibility to achieve a visual effect is to arrange individual embossing protrusions such that they form a linear pattern. An example for such linear alignment of individual embossing protrusions is disclosed in U.S. Pat. No. 6,520,330 B1. The embossing pattern shown therein is formed by identical embossing protrusions which have different distances to the neighboring embossing protrusions so that an optical appearance is created.

A further possibility is to create an optical appearance by selecting different sizes of embossing protrusions. Such patterns are shown in EP 1 253 242 A2 or EP 1 209 289 A1 also using the concept of aligning single embossing protrusions.

EP 0 738 588 A1 relates to the generation of an appealing visual effect by the positioning of glued and unglued areas.

SUMMARY OF THE INVENTION

It is the object of the invention to provide a fibrous product with an appealing optical appearance and a method for producing same.

This object is solved by a fibrous product with the features discussed herein and a method for producing a fibrous product. Preferred embodiments follow from the dependent claims.

The fibrous product (10, 20, 20*b*, 30) according to the invention is especially a tissue paper product, non-woven product or a hybrid thereof, and preferably a hygiene and cleaning product. It has at least a first ply with at least one embossing pattern comprising embossed depressions starting from a base plane of the ply, wherein the embossing pattern is characterized by the following features:

- the embossing pattern has a minimum motive surface area of at least 3 cm×3 cm;
- the pattern comprises a high number of embossed depressions which are sized and/or positioned such as form a motive element covering the motive surface area; wherein
- at least some of the embossed depressions are sized and/or positioned such that the minimum distances between pairs of consecutively arranged embossed depressions vary.

The term non-woven according to ISO 9092, DIN EN 29092 is applied to a wide range of products which, in terms of their properties are located between those of paper (DIN 6730, May 1996) and cardboard (DIN 6730) on the one hand, and textiles on the other hand. As regards non-woven a large number of extremely varied production processes are used, such as the air-laid and spun-laced techniques as well as the wet-laid techniques. The non-wovens include mats, non-woven fabrics and finished products made thereof. Non-wovens may also be called textile-like composite materials, which represent flexible porous fabrics that are not produced via the classic methods of weaving warp and weft or by looping. In fact, non-wovens are produced by intertwining, cohesive or adhesive bonding of fibers, or a combination thereof. The non-woven material can be formed of natural fibers, such as cellulose or cotton fibers, but can also consist of synthetic fibers such as polyethylene (PE), polypropylene (PP), polyurethane (PU), polyester, fibers on the basis of polyethylenterephtalate, polyvinyl alcohol, nylon or regenerated cellulose or a mix of different fibers. The fibers may, for example, be present in the form of endless fibers or pre-fabricated fibers of a finite length, as synthetic fibers, or in the form of staple fibers. The non-wovens as mentioned herein may thus consist of mixtures of synthetic and cellulose fibrous material, e.g. natural vegetable fibers (see ISO 9092, DIN EN 29092).

The term "hygiene products" and "cleaning products" as used herein comprise bathroom tissue, household towels, handkerchiefs, facial tissues, napkins, wiping and cleaning products as well as table ware. It does not comprise wall paper products.

This fibrous product is produced by means of an embossing roll which will be explained in more detail below. Reference to at least a first ply indicates that the fibrous product can be a single ply or multi ply product. Besides the at least one first ply, there can be additionally one or a plurality of backside plies. If there are two or more first plies this means that these plies are embossed together with the embossing roll. The fibrous product as claimed has embossed depressions generated by the embossing protrusions of the embossing roll. The embossing depressions form at least one pattern with a motive surface, the minimum area of which is at least 3 cm×3 cm.

According to a preferred embodiment, the individual embossed depressions are dots having a cross-sectional shape which is essentially circular or essentially elliptical or essentially square-shaped and which are arranged regularly to form a regular raster. This corresponds again to the above-discussed amplitude modulated raster arrangement. In order to achieve the desired optical appearance, preferably the heights and/or sizes of the regularly arranged individual dots vary. According to an alternative, the individual embossing depressions are arranged in a random manner and have the same sizes. This corresponds to the above-discussed frequency modulated raster arrangement (also called stochastic or random raster).

According to a preferred embodiment, individual embossed depressions are essentially circular dots forming first regions, in which the dots are arranged regularly to form a raster, wherein the dots within the first regions do not all have the same heights and/or sizes, and second regions in which the dots are arranged in a random manner. This is a combination of an amplitude modulated raster in certain parts of the motive surface area and a frequency modulated raster in other parts of the motive surface area. Such a combination is called a hybrid raster. Combinations of regular arranged raster dots of one size and one orientation in one area and regular arrangements of other dots of other sizes or other orientations in another area can provide unexpected visual effects with a certain similarity to pop art pictures imitating enlarged comics.

Other options to increase the visibility of the pattern or to influence its visual appearance in case of a regular arrangement of the individual embossed dots is the angular arrangement of a regular grid of circular dots which can vary within one rastered motive pattern. In case of non-circular dots, it is additionally possible to change the orientation of the individual embossed depressions, e.g. by varying the main axis of embossed depressions with an ellipsoidal cross-sectional shape.

In order to support such visual appearance, the fibrous product preferably further comprises second embossed depressions having a linear shape. Such linear embossed depressions can serve to enhance the visibility of linear shapes in the motive or to delimit different surface areas against each other.

According to a preferred embodiment of the invention, the fibrous product comprises at least one further ply forming the backside ply, which can be unembossed. Such a product is easy to manufacture because the unembossed backside ply can be directly transferred to the marrying unit where it is bonded to the top ply.

It is also possible that the so-called "first ply" and the so-called "backside ply" can exchange their positions depending on the specific converting process, especially depending on the folding and the winding steps.

Alternatively, the backside ply (plies) can have the same embossing pattern as the first ply or it can be a mirror image of the first ply. The definition which of the plies is the top ply and which is the backside ply is then arbitrarily. In the other cases in which the backside ply does not have the specific arrangement of the embossing depressions forming a pattern representing a motive, the first ply is the one representing the rastered motive. Additionally, the product can also have one or more middle plies non-embossed or embossed separately from the first ply or plies and the backside ply or plies.

According to a further alternative embodiment, the backside ply or backside plies is/are embossed with a second embossing pattern different to the embossing pattern of the first ply or plies, the second embossing pattern preferably comprising a micro embossing pattern. A micro embossing pattern is a relatively regular pattern of densely arranged small embossed protrusions. A density of embossed elements of more than 20/cm$^2$ is defined herein as a micro embossing pattern. Such a micro embossing pattern can be selected freely based on functional criteria in order to give the fibrous product certain characteristics in term of overall strength, bulk or smoothness. Optical requirements and effects do not play any decisive roll when selecting a suitable micro embossing pattern.

According to a preferred embodiment of the invention, at least some of the embossed depressions of the first ply or plies are colored. This serves to enhance the visibility of the embossed depressions and can be applied to some of the embossed depressions only, like e.g. the eyes of an animal to achieve specific effects.

Preferably, the embossed depressions are colored with ink or colored adhesive which is applied by means of specific application rollers cooperating with the embossing roll and transferring the desired ink or dye towards specific parts of the embossing roll. In order to color only certain parts of the roll, care has to be taken that the embossing roll and the application device for ink or colored adhesive is run in strict synchronicity. When using colored adhesive, the adhesive used for ply bonding the first ply and backside ply is used to enhance the visibility of certain parts of the embossed depressions of the first ply, and at the same time serves to bond together the first ply and the backside ply.

Preferably, the optical appearance and visibility of the desired motive element of the first product can be supported by providing perforations in case of a rolled product or by providing single sheets which are preferably folded and/or stacked. In other words, rolls of household tissues like kitchen wipes can additionally have perforations which are preferably in register with the desired rastered motive surface area in order not to destroy the visual effect when individual parts of the household tissue are separated from a roll of such material. Same applies to toilette papers. Such technique is desired in WO2006/099881. Alternatively, the product can be made of single sheets which are preferably stacked and with the desired rastered motive surface on each sheet.

According to a preferred embodiment, the first ply and the backside ply are bonded together at the tips of embossed depressions of the plies facing each other.

In another preferred embodiment of the invention, the multi-ply fibrous product comprises at least one middle ply which is volume embossed. The technique of volume embossing of conventional products is known from WO2002/103112 the teaching of which is incorporated herein by reference. A volume embossed middle ply serves to impart a high volume to the product and might be used if a product with the feeling of a high volume is desired.

According to a preferred embodiment, the fibrous product comprises four plies, at least a middle ply adjacent to the first ply being embossed together with the first ply.

Another possibility to achieve ply bonding is mechanical ply bonding. Preferably, the fibrous product comprises at least two plies which are ply bonded by mechanical ply bonding, preferably knurling, along at least one longitudinal edge of the product. Likewise, edge embossing can be performed along all four sides of the product.

According to a further preferred embodiment of the invention, the fibrous product has two plies wherein the embossing pattern of the first ply and the embossing pattern of the backside ply are arranged such that they are nested into each other.

This again makes it necessary that the embossing rolls for the top ply and the at least one further ply are operated in register such as to realize a well defined nested arrangement of the plies once brought together.

In this context, it is also possible that the first ply of the fibrous product has an embossing pattern with embossed depressions whereas the backside ply has embossed stabilizing elements which project into the cushions of the first ply. Such a structure has the advantage that relatively large dimensioned cushions can be provided on the first ply and which are stabilized by the stabilizing elements of the backside ply. For more detailed description of the concept of providing stabilizing elements, reference is made to WO2006/136186 the teaching of which is incorporated herein by reference. The embossed stabilizing elements of the backside ply can serve to support the non-embossed areas of the top ply, especially in case of larger dimensioned non-embossed areas to avoid collapsing.

The method for producing a fibrous product, especially tissue paper product, non-woven product or a hybrid thereof, a preferably a hygiene and cleaning product, comprises the steps of directing a single-ply first ply or a multi-ply first ply into the nip between an embossing roll and an anvil roll as described as follows:

The embossing roll has protrusions starting from, its base circumferential surface, wherein the protrusions form at least one pattern with a base surface area of at least 3 cm×3 cm; within at least one of the patterns there is a high number of embossing protrusions (53) which are sized and/or positioned such as to represent a rastered motive element covering the base surface area; and wherein at least some of the embossing protrusions (53) are dimensioned and/or positioned such that consecutive minimum distances between opposed side surfaces of pairs of embossing protrusions arranged in sequence vary gradually.

Preferably, the method further comprises the additional step of applying a colored substance onto the web, preferably ink or colored adhesive at the protruding parts of the embossing roll. This measure serves to improve the visual effect of the embossed motive element of the product.

According to a preferred embodiment, the method further comprises the step of mechanical ply-bonding at least some of the plies, preferably by edge embossing or knurling. Another preferred embodiment of the inventive method for producing a multi-ply fibrous product is the bonding together the top ply and the further ply/plies by means of a mechanical ply bonding. Such mechanical ply bonding which, for example, can be carried out by means of an edge embossing technique and/or by knurling, can either be carried out without the use of an ink or in additional to the application of an ink. If mechanical ply bonding is carried out, the resulting product can retain a high degree of softness because the plies are only interconnected where a mechanical ply bonding was carried out. In case of a mechanical ply bonding in addition to laminating together the top ply/plies and the further ply/plies by means of adhesive and additionally ply-bonding further plies by means of mechanical ply bonding, any desired combination of ply bonding and a variation of the characteristic properties of the multi-ply product influenced by adhesive bonding can be freely selected.

According to a further preferred embodiment of the method for producing a fibrous product with at least one backside ply, there are the additional method steps of embossing the at least one backside ply in the nip between a second embossing roll and a second anvil roll and combining the first ply or the first plies and the at least one backside ply in the nip between one of the embossing rolls and a marrying roll.

In addition to this, the method preferably comprises the step of applying adhesive to the embossed protrusions of the first ply or first plies before combining the first ply or first plies and the at least one backside ply in the nip between the embossing roll and a marrying roll. To this end, an application device for applying adhesive towards the embossing roll has to be provided. This technique for applying the adhesive can be used in combination with ordinary manufacturing techniques like the Goffra Incolla-type processing and an embossing device in which at least two plies are combined using a Nested-method. In an attempt to influence the mechanical behaviour of the multi-ply fibrous product, the adhesive can be applied selectively on specific protrusions of the web. In other words, the adhesive is not applied to all protrusions but only in selected sections of the web so that the overall ratio of the surface area in which adhesive has been applied relative to the overall surface area can be varied within a broad range.

Further, it is preferred that the adhesive used in the method is colored in order to increase the visibility of the rastered motive.

For laminating together the single webs of material, different types of adhesive can be used. Suitable adhesives are, inter alia, glue on the basis of starch or modified starch like for example methyl cellulose or carboxylized methyl cellulose and adhesively acting polymers on the basis of synthetic resins, caoutchouc, polypropylene, polyisobutylene, polyurethane, polyacrylates, polyvinylacetat or polyvinyl alcohol. Such adhesives can also contain coloring agents in order to improve the optical appearance of the finished products. Frequently, water based glues are used for laminating together paper layers.

Another option to increase the visibility or to enhance the visual appearance of the product is to provide a multi-ply fibrous product which has at least one ply with a color that is different to the color of the other ply or plies. The provision of a selected ply having a different base color can provide interesting visual effects in combination with a first ply representing a motive element covering the motive surface area.

Preferably, the method further comprises the step of applying different colored substances to defined embossed protrusions of the first ply or first plies, preferably on a side which is directed to the at least one backside ply in the finished product. This also serves to create a specific desired optical appearance of a multi-colour fibrous product.

As regards the temperature at which the process is carried out, it is possible either to use room temperature or using heat embossing. The use of heat embossing technique serves to realize geometries which are complex, and therefore difficult to realize for a given fibrous product especially for non-woven products or hybrid products. In other words, the application of heat might be beneficial to realize highly complex embossing geometries in the inventive product, e.g. where embossed depressions should be placed in a relatively close distance to each other. Further, heat embossing may increase the stability of the embossed geometry. Heat embossing can also be used to ply-bonding of a multi-ply product of at least one non-woven ply without the use of glue.

According to a preferred embodiment of the invention, the top (or first) ply/plies and the at least one further ply or backside ply are laminated together in a Pin-to-Pin arrangement. In other words, the at least one further ply is also embossed using a similar or identical rastered embossing roll such that embossed protrusions of the top ply and the at least one further ply which contact each other can be laminated together Pin-to-Pin. This implies that the embossing rolls for the top ply and the at least one further ply are operated in register in order to produce a well-defined and reproducible effect. Laminating the first ply or the first plies and the backside ply (plies) together according to the pin-to-pin technique should be carried out without a marrying roll and ply-bonding should takes place between the first embossing roll and a second embossing roll.

According to another preferred embodiment of the method, the first ply or first plies and the at least one backside ply are laminated together in a nested arrangement. This again makes it necessary that the embossing rolls for the top ply (plies) and the at least one further ply are operated in register such as to realize a well defined nested arrangement of the plies once brought together.

The embossing roll for producing such fibrous products comprises an embossing surface suitable to run against an anvil roll, wherein the embossing surface comprises protrusions starting from a base circumferential surface of the embossing roll. The embossing roll is characterized by the following features:

- the embossing protrusions form at least one pattern with a base surface area of at least 3 cm×3 cm, preferably 5 cm×5 cm and most preferably at least 9 cm×11 cm;
- within at least one of the patterns there is high number of embossing protrusions which are sized and/or positioned such as to represent a Rastered motive element covering the base surface area; wherein
- at least some of the embossing protrusions are dimensioned and/or positioned such that consecutive minimum distances between opposed side surfaces of pairs of embossing protrusions are arranged in sequence vary gradually.

In other words, the embossing roll is manufactured such that a high number of embossing protrusions cooperate together to form a pattern, preferably a repeating pattern, with a base surface area of at least 3 cm×3 cm, preferably 5 cm×5 cm and most preferably at least 9 cm×11 cm. A high number of embossing protrusions should be understood to be at least 100, preferably at least 300. Such base surface area is not a flat surface because of the cylindrical shape of the embossing roll. However, when used for producing fibrous products, it generates a motive element on a flat fibrous product wherein the motive element has the size of at least 3 cm×3 cm, preferably 5 cm×5 cm and most preferably at least 9 cm×11 cm. The term motive element intends to characterize a unitary, complex picture which does not necessarily represent a certain article, person or scenery but can also be an abstract motive. Nevertheless, it is identified as being coherent in itself and not made up of a repetition of small subunits. Examples for such a motive element could be a person, an animal, a certain article or a famous building or scenery. In order to achieve this, the embossing protrusions within each pattern representing a Rastered motive element are dimensioned or positioned or both dimensioned and positioned such as to resemble a raster image as used in printing technology. To this end, the embossing protrusions are dimensioned and/or positioned such that consecutive minimum distances between opposed side surfaces of pairs of embossing protrusions arranged in sequence very gradually. This means that, wherever appropriate, the visual appearance of such embossing protrusions resembles the grey scale of a motive so that gradually changing grey scales are either represented by a variation of the minimum distances between adjacent embossing protrusions or by a variation of the sizes of the embossing protrusions.

In principle, there are few basic possibilities to produces rastered images. The individual embossing protrusions can be arranged symmetrically but with different sizes. This corresponds to so-called amplitude modulated raster (AM-raster) in printing. The second possibility is to arrange the embossing protrusions randomly leading to a frequency modulated raster (FM-raster). Further, a combination of both basic principles is also possible leading to a hybrid raster. However, in all the above cases, it is the minimum distances between opposed side surfaces of adjacent pairs of embossing protrusions which vary according to the tone value or color intensity to be represented by the embossing protrusions within the motive element. This does not exclude that in regions of the motive element represented by the embossing protrusions, the tone value or color intensity can be constant. In that case, the arrangement of consecutive embossing protrusions also follows a constant pattern with equal distances between the embossing protrusions. Nevertheless, all embossing protrusions within a repeating pattern, i.e. within the base surface area cooperate together to represent the desired motive element covering the base surface area.

In order to arrive at a fibrous product with a good optical appearance of the rastered embossing, the embossing roll is preferably made of metal, especially steel, or hard plastics materials or hard rubber. In case of plastics, a very hard plastic material is preferred, alternatively a resin material is also possible.

Preferably, the embossing surface is formed by masking-etching and/or moletage processing and/or mechanical machining. The masking process is often performed with a wax jet or with a laser partly ablating the mask. Such processing techniques are able to lead to a high variety of surface geometries, wherein the moletage processing is mainly used in combination with an etching technique which is applied where the metal after the moletage step was deformed most. Alternatively, the embossing surface of the inventive embossing roll can also be formed by mechanical machining, especially milling, which, however, can also be carried out in addition to masking etching and/or moletage processing.

With these production technologies at hand, it is possible to freely shape the embossing surface of the embossing roll so that the limits imposed to a free shape of the embossing roll is not the geometry of the roll itself but the use of a shape which the inventive fibrous product still can substantially follow in the course of the embossing process.

The embossing protrusions have a minimum height of 0.4 mm and a maximum height of 2.0 mm. This range of heights was found to provide a good visual effect in a fibrous product embossed by means of such embossing roll.

The individual embossing protrusions can be equidistantly arranged within each repeating pattern and some of the individual embossing protrusions have different sizes and/or shapes. This relates to the above-referenced amplitude modulated raster with symmetrically arranged embossing protrusions but different dimensions of embossing protrusions. The desired visual effect can be achieved both by varying the size of geometrically identical protrusions, varying the heights of the protrusions or by varying the shapes of individual embossing protrusions. It is also possible to combine these measures within one motive element so that, for example, the linear character of certain parts of the motive elements could be represented by an embossing element having a linear shape.

Preferably, the embossing roll further comprises additional embossing protrusions having a lower height over the base circumferential surface, preferably a first lower height of about 0.9 mm and a second lower height of about 1.3 mm over the base circumferential surface.

The individual embossing protrusions within each pattern can be of equal size but distances between adjacent individual embossing protrusions may vary in order to create the rastered motive element. This represents the second alternative basic principle to design a raster image. There is no longer a symmetrical arrangement of the embossing protrusions but a so-called frequency modulated raster as explained above in which high density and low density regions are formed by varying the distances between adjacent individual embossing protrusions.

According to another alternative raster technology, the embossing roll comprises second embossing protrusions which are elongate ribs having a lateral extension which exceeds 4 mm and preferably 10 mm. Such elongate ribs can have a regular shape in terms of the base surface, top surface and a fixed slope angle but can also have a height which changes in at least one section of the rib in the longitudinal direction of the rib or can have a width which changes in a longitudinal direction of the rib in at least that section of the rib. Both above characteristics, the optional changing of the height of the rib and the changing of the width of the rib can be realized separately or in combination together and serve to increase the variability of a possible shapes to best suit a desired optical appearance of the fibrous product embossed with such an embossing roll. Alternatively, it is also possible to create "linear" embossed depression by arranging single embossing protrusions such that they touch each other.

The above-described second embossing protrusions being elongate ribs can be freely shaped, whereas preferably the basic embossing protrusions are conventional embossing protrusions with a base surface, top surface and a fixed slope angle. Conventional embossing protrusions comprise truncated cones of pyramids with polygonal or round or oval base areas, cylinders with polygonal or round oval base areas, elements with a base area which is circular, elliptical or a regular polygon with curved side surfaces. More complex shapes are e.g. stepped pyramids. Such conventional embossing elements typically have a maximum extension in the base plane up to 4 mm. However, it is preferred that the individual embossing protrusions within each pattern have a circular cross-sectional shape with a diameter at the top circumferential surface ranging from 0.1 mm to 3.3 mm.

The device for producing a fibrous product, especially tissue paper product, non-woven product or a hybrid thereof, and preferably hygiene and cleaning product comprises an embossing roll as described above and a cooperating anvil roll. Preferably, the anvil roll is made of rubber like EPDM or NBR (nitrylbutadien rubber), paper or steel.

Preferably, the anvil roll has a hardness between 20 Shore A and 85 Shore A, preferably between 35 Shore A and 60 Shore A and most preferably a hardness of about 45 Shore A.

The device for producing the inventive fibrous product comprises a pre-embossing device for the at least one further ply forming the backside ply. Such pre-embossing is carried out before the further ply is directed into the nip between the embossing roll and the marrying roll.

The device can further comprise a device preferably close to the embossing roll for applying adhesive to the first ply. Such device for applying adhesive is arranged such that the first ply being processed can be arranged around the embossing roll and being in contact to a conventional device for applying adhesive to the side of the first ply not being in contact with the embossing roll.

The device comprises a marrying roll running against the embossing roll for bonding together the at least one first ply or first plies and at least one further ply. Such marrying roll is used in the conventional Goffra Incolla type process or for an embossing machine providing a nested arrangement of two embossed plies.

However, a marrying roll is not necessary in case of a direct bonding together of two embossed plies using the above-described Pin-to-Pin ply bonding in which the tips of the embossing patterns of two plies face each other at least in some areas and are laminated together at such tips. In such a case, the device preferably comprises a further embossing roll running against the inventive embossing roll for embossing at least one further ply. This further embossing roll might be also an inventive embossing roll. However, it is also possible to use a conventional embossing roll which applies conventional embossing elements to the backside ply such that in selected positions relative to the inventive embossing roll processing the top ply, the tips of the embossing elements generated with both embossing rolls face each other in order at least in some areas to achieve a Pin-to-Pin arrangement and bonding of the two plies.

Preferably the device further comprises a knurling roll running against the metal roll for achieving a mechanical ply bonding.

The device can further comprise at least one color application device for applying colored substances towards embossing protrusions of the embossing roll. Especially preferred is the provision of two color application devices coloring different parts of the web corresponding to the protrusions of the embossing roll, so that differently colored regions can be achieved.

The method for arranging embossing protrusions on the circumferential surface of an inventive embossing roll to be used in the inventive method comprises the method steps of:

- scaling a selected design or photograph to the size of a selected base surface area on the circumferential surface of the embossing roll;
- changing the design or photograph into a grey scale picture;
- setting a Gamma curve such as to define a correlation between grey scales and desired dot sizes and or dot densities; and
- transferring the dot sizes or dot densities in correspondingly shaped or arranged embossing protrusions on the base surface area of the embossing roll.

As used herein, the expression dot includes also other shapes of elements besides elements with a circular cross-section, like lines, ellipses or rips also known from rastering technology.

This method will be explained by means of a specific example in the detailed description of the embodiments. The essential point is to find a suitable correlation between grey scales in the grey scale picture and the distribution or size of the individual dots leading to a specific coverage representative of the grey scales. Different to rastered pictures in printing technology, where the raster can be completely inversed depending on the grey scales, i.e. starting from single black dots on a white surface and ranging to single white dots on a black background surface, the embossing roll achieves the visual effect by means of embossing protrusions only. This means that there is no inversion effect as described above. Therefore, care has to be taken that the grey scale picture only covers technically achievable embossing surfaces of the embossing roll where the highest values of the grey scales are mainly represented by individual dots which, however, have a large size and/or are arranged closely to each other.

Preferably, at a grey scale value of 50% the maximum dot density and/or maximum dot size is already reached. This reflects the fact that there is no possibility to achieve a color inversion like in printing technology.

According to a preferred embodiment of this method, embossing protrusions having a circular cross-section are selected. Further, it is preferred that the dot sizes range from a top surface area of about 0.01 $mm^2$ for regions with the lowest grey scale value to about 10 $mm^2$ for regions with the highest grey scale values, preferably ranging from top surface areas of about 0.5 $mm^2$ to about 5 $mm^2$.

Within the rastering process different angles between 0° to 90° can be selected which describe the arrangement of dots relative to each other. The dot shape can also be selected. The simplest shape is circle, other common once are squares, ellipses, diamond-shapes, hearts or crosses. Of course other shapes or combinations of different dot-shapes are possible, e.g. using round dots for small "grey levels" and diamond-shaped dots for higher "grey-levels". A further possibility is to use different dot forms for different orientation of the dots in different areas of the design and the embossed roll or the product respectively, e.g. in one area elliptical dots are oriented with their main axis in 10° direction, in another area in the direction of 55°. Such an arrangement can give additional interesting optical effects.

The most common rastered technology is amplitude modulated rastered technology (AM). Within this technology, the rastered dots are arranged regularly relative to each other. That means that the dots are arranged in a regular matrix with a defined distance between the middle of each dot to the middle of any neighboring dot. This distance in known as the so-called raster width and the reference angle as raster angle.

Instead of using AM-rastered technology, frequency modulated raster technology (FM) can be used. Instead of an arrangement within a defined matrix, the dots are arranged randomly wherein the grey levels are defined by the density of the dots.

Furthermore, combinations of AM- and FM-raster technologies are possible. For example, in one area of the design, dots can be arranged randomly (FM-raster), whereas within another area the dots are arranged regularly (FM-raster). Another possibility of combining AM and FM raster is to arrange the dots randomly and varying both the dot density and the dot sizes corresponding to the grey level of the design. A further possibility of combining AM and FM raster technology is to arrange the dots regularly but leaving out some of the dots when lower "grey levels" are needed. The combination of AM and FM raster technology is also known as hybrid raster.

Instead of using automatic raster technologies using raster image processors, the dots can be set manually. This leads to a more artistic impression of the image.

A further possibility of generating a rasterized image can be the combination of automatic rastering with manually rastering. This combination can be useful for increasing visual recognition. For example, a person or animal can be rastered automatically but in order to increase the visual appearance of the eyes or of hairs, such parts of the automatically generated raster image can be reworked manually.

A further possibility of creating improved rasterized images is the combination of rasterizing dots with some solid elements like lines. For example, the eyes and the hairs of a rastered animal picture can be visualized with line-shaped elements whereas the rest of the motive element is visualized by means of single dots.

If the single image forming the motive element is smaller than the complete surface of an embossing roll, the design is usually repeated several times in machine direction and/or cross direction. Instead of using a single image several times, also several images can cover the surface of an embossing roll so that a sequence of individual motive elements is produced.

Preferably, the original images appear as mirror images on the surface of the embossing roll, because within the embossing process of the fibrous web, the embossed image on the final product is again a mirror image of the embossing roll and thus showing the original image again.

If several motive elements are engraved on the embossing roll, it is preferred that those areas, in which the designs are joining each other both horizontally and vertically, are reworked such that the joining edges of the individual motive elements are not visible.

Preferably, the embossing protrusions are arranged with a frequency between 1 and 10 protrusions per centimeter on the circumferential surface of the embossing roll. In other words, the embossing protrusions are arranged within a regular pattern of raster cells being sized between 1.0 mm×1.0 mm and 10 mm×10 mm on the circumferential surface of the embossing roll. Preferred is a range between 1.3 mm×1.3 mm and 5 mm×5 mm.

Preferably, the embossing protrusions comprise at least five different sizes and/or distances between them, more preferably at least ten different sizes and/or distances and most preferably at least twenty different sizes and/or distances between them.

BRIEF DESCRIPTION OF THE DRAWINGS

In the following, the invention will be described by way of example only with reference to the drawings, in which FIG. 1(*a*) to (*c*) show a sequence indicating how to design the embossing surface of an embossing roll.

EMBODIMENTS OF THE INVENTION

Figure 1:
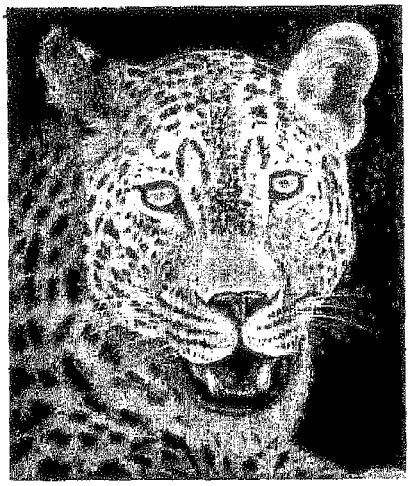
Figure 1:
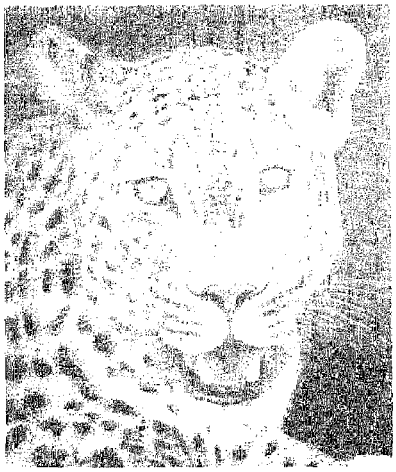
Figure 1:
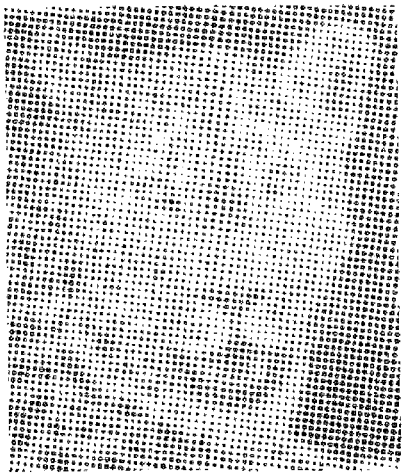

In the following, it will be explained how, starting from a suitable photo or design, the embossing surface of an embossing roll, and more specifically the position and size of the embossing protrusions on the embossing surface of an embossing roll can be selected. The repro work can start either from a photograph or design which is colored or which is in grey level. For the sake of simplicity, FIG. 1 starts with a grey level photograph of a leopard as shown in FIG. 1(*a*). The following steps of the repro work can be carried out with commercially available repro work programs like Photoshop, Nexus, AVA or others. After having selected the photograph or design it is scanned and used in electronic form on a computer. For example, the picture can be used as a tif-file. In order to arrive at the suitable motive element on the embossing roll, the design can be first trimmed and scaled on order to fulfill the needs of the desired optical effect and in order to fill a base surface area of at least 3 cm×3 cm to be used as a repeating pattern on the embossing surface of the embossing roll. If the photograph or design is still in color, it is changed into a grey scale picture as shown in FIG. 1(*a*) corresponding to the input by a grey level photograph.

In a next step, the Gamma curve is set such that the grey scales are limited to a range which can be represented by a selection of individual dot sizes of the embossing protrusions. Different to a printing product like a newspaper, where a high maximum value of the Gamma curve is possible and represented by a black area, the requirement to design an embossing roll with distinct embossing protrusion makes it necessary to restrict the Gamma curve to a maximum value of around 50%. Therefore, a reduced Gamma scope between a minimum value of around 5% and a maximum value of around 50% is necessary and leads to a grey scale picture as shown in FIG. 1(*b*).

After that, the grey scales in picture 1(*b*) are translated into individual raster dots. The result of such conversion is shown in FIG. 1(*c*) and uses a symmetrical arrangement of the individual raster dots corresponding to an amplitude modulated raster in which the position of the individual dots is regular but the sizes of the dots represent the grey scale values. Alternatively, the grey scale picture according to FIG. 1(*b*) could also be translated into a frequency modulated raster where the individual size of the dots is the same but the distance between individual dots represents the grey scale values.

The raster image according to FIG. 1(*c*) corresponds to the position and size of individual embossing protrusions starting from a base or conferential surface of an inventive embossing roll. However, before the raster image according to FIG. 1(*c*) is translated into the embossing surface of an embossing roll, additional method steps can be carried out like a manual rework of the edges of the design to hide the repeat or, when ever appropriate, a manual rework in order to increase the contrast of the raster image received.

Figure 2A:
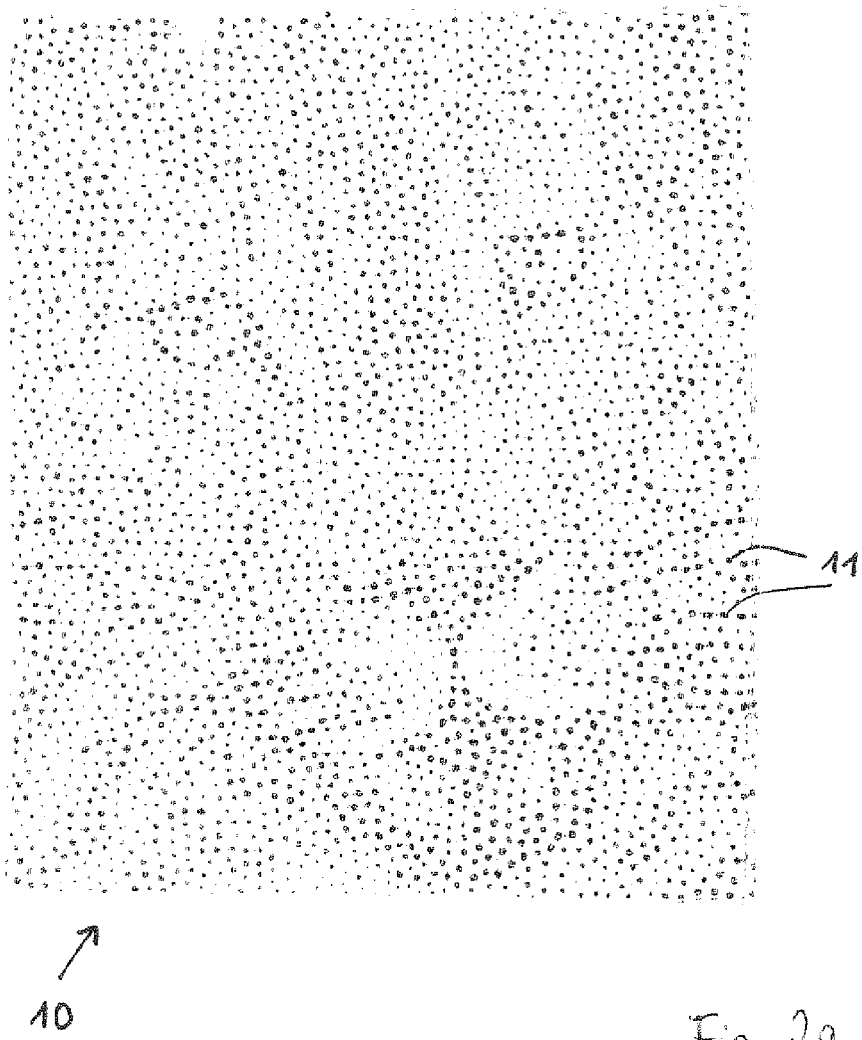
FIG. 2*a* shows an example of an embossed inventive fibrous product.

FIG. 2*a* shows a product 10 as produced with an embossing roll manufactured in a way as described with reference to FIG. 1(*c*). It is not identical to the raster image according to FIG. 1(*c*) in terms of the scaling of the design and certain other differences. Comparing FIG. 1(*c*) and FIG. 2*a* it becomes also evident that a manual rework might has been used in order to increase the visibility of the whiskers of the big cat forming the motive element as shown. Whereas the raster image according to FIG. 1(*c*) is an amplitude modulated image, the raster image according to FIG. 2*a* has individual embossments which do not seem to follow a fixed raster width. Both the sizes of the individual embossed depressions (11) of the product (10) as well as the arrangement of individual embossed depressions do not follow a fixed predefined distance.

FIG. 2*a* is a photocopy of a product sample (one sheet of bathroom tissue) of an inventive product. The visibility of the individual embossed dots (11) stems from the lamination of a multi-ply product with colored glue before marrying.

Another alternative possibility, however, is to use a colored embossing technique in which embossed dots in the embossed ply or plies are colored with ink. The first embossed plies and the backside plies are not married and no glue is used. Instead, mechanical ply bonding is achieved by knurling or another type of edge embossing.

Another way to increase the optical appearance of a fibrous product is to combine differently colored base plies and to combine them with a suitable ink color.

In all variants of a rolled product, it is preferred to perforate the product in register with the embossed motive and also to cut the product in register with the embossing so as not to impede the visual effect conveyed by the embossing pattern.

Figure 2B:
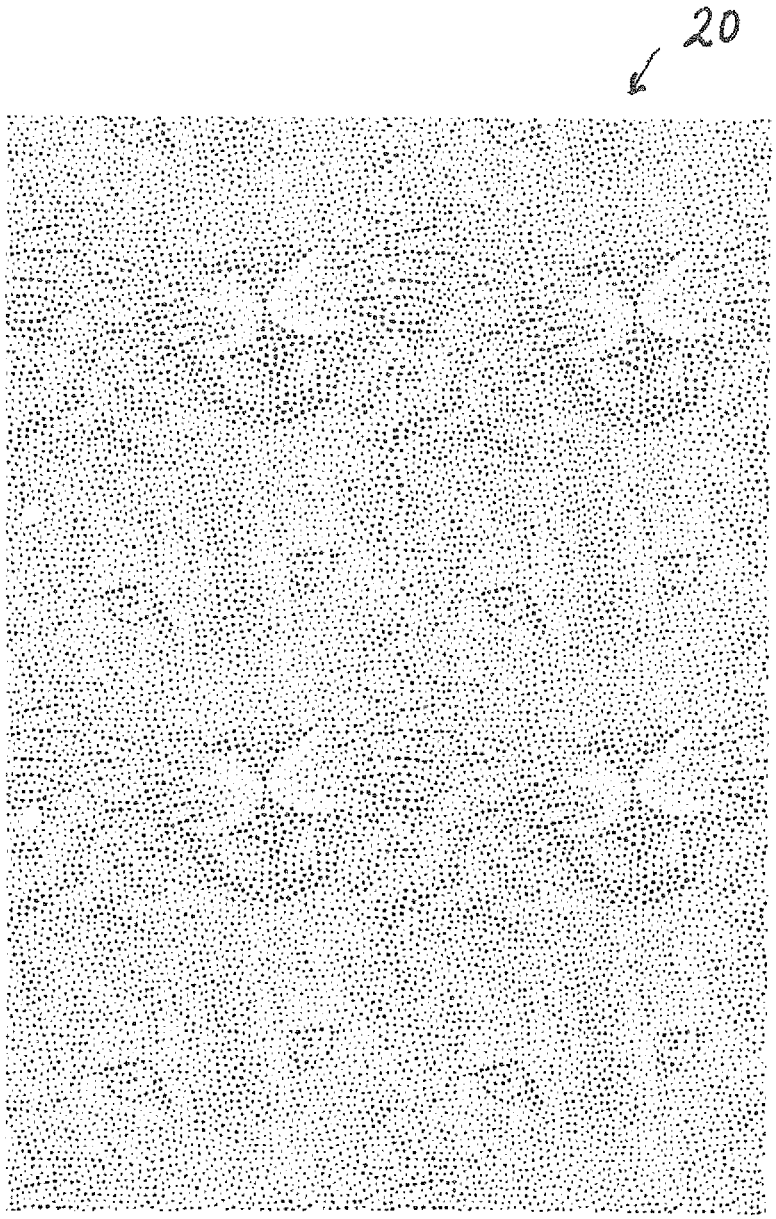
FIG. 2*b* shows another example of an embossed inventive fibrous product.

FIG. 2*b* shows another example case of a larger scale inventive product 20 like a kitchen towel. In such a case, there is the repeating pattern of the individual motive elements (leopard) which are arranged such that the repeat between the individual motive elements is hidden. In order to achieve this, the above described manual rework to repeat join lines between adjacent motive elements is advisable. Otherwise, the production of the fibrous product 20 as shown in FIG. 2*b* is identical to that according to the fibrous product 10 as shown in FIG. 2*a* and all above explanations and details apply likewise.

Figure 3A:
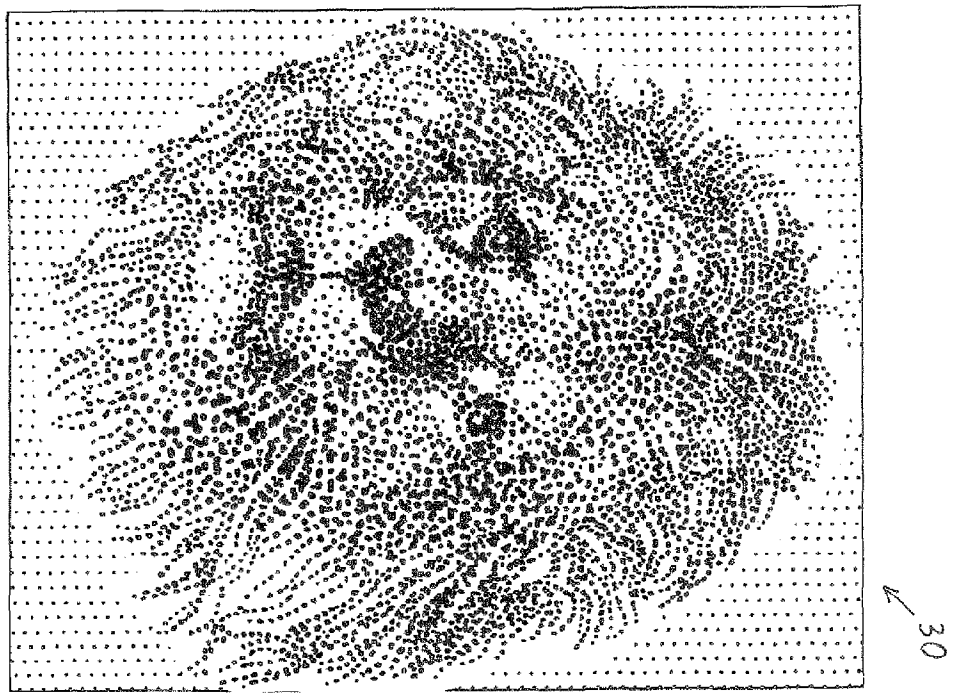
FIG. 3*a* shows another example of an embossed inventive product.

FIG. 3*a* shows another example of a tissue product 30 in which only a few characteristic parts of a well-known motive are translated into differently sized embossed dots representing the overall motive element. In order to increase the visibility of the rastered motive element, special parts thereof could be additionally colored with ink. Further, a motive like that as shown in FIG. 3*a* could additionally be provided with an embossed logo so that it is also possible to add a certain text or trademark to the motive element.

Further, it can be seen of FIG. 3*a*, that some of the embossed dots are arranged so close to one another that they appear like a complex shaped embossed dot formed by the cluster of individual embossed dots.

Figure 3B:
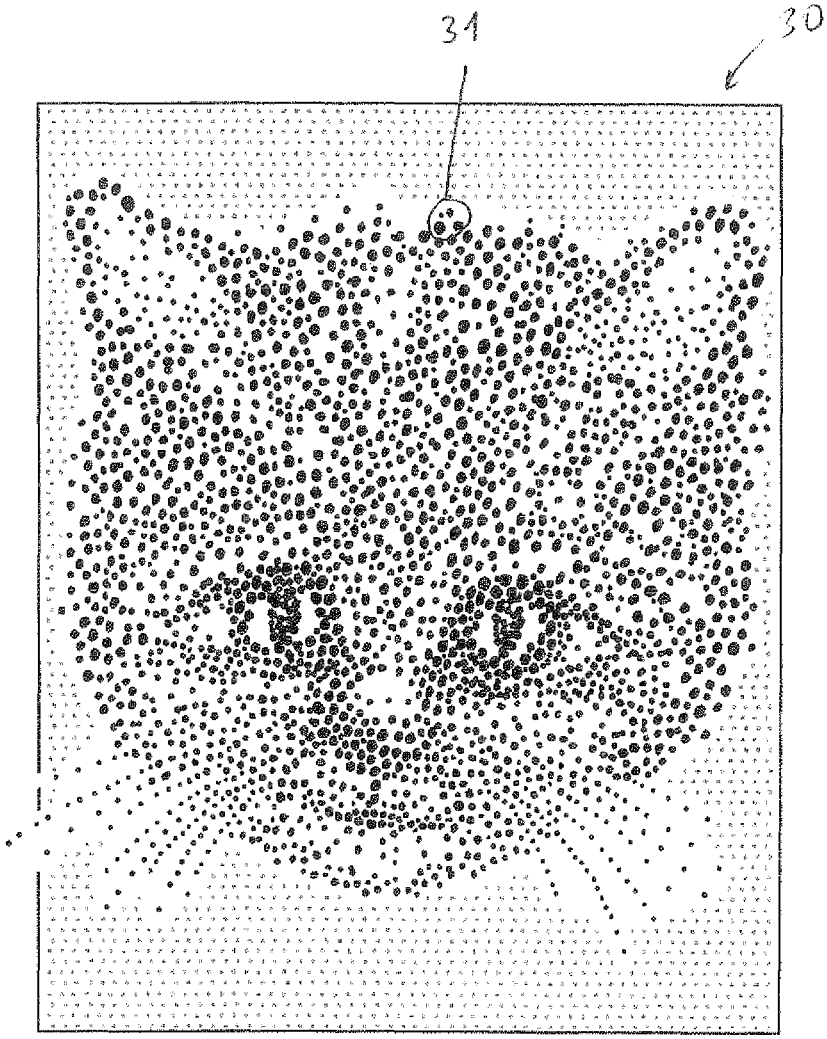
FIG. 3*b* shows another example of an embossed inventive product.

FIG. 3*b* represent another example of an inventive fibrous product with a different motive element which is formed by individual dots having both a largely different size as can be seen e.g. by looking at section 31 of the rastered motive element. Moreover, it also follows from section 31, that there is no regular arrangement of the embossed dots so that the motive as shown in FIG. 3*b* represents a hybrid raster being both frequency modulated and having different sizes of the individual dots.

Figure 3C:
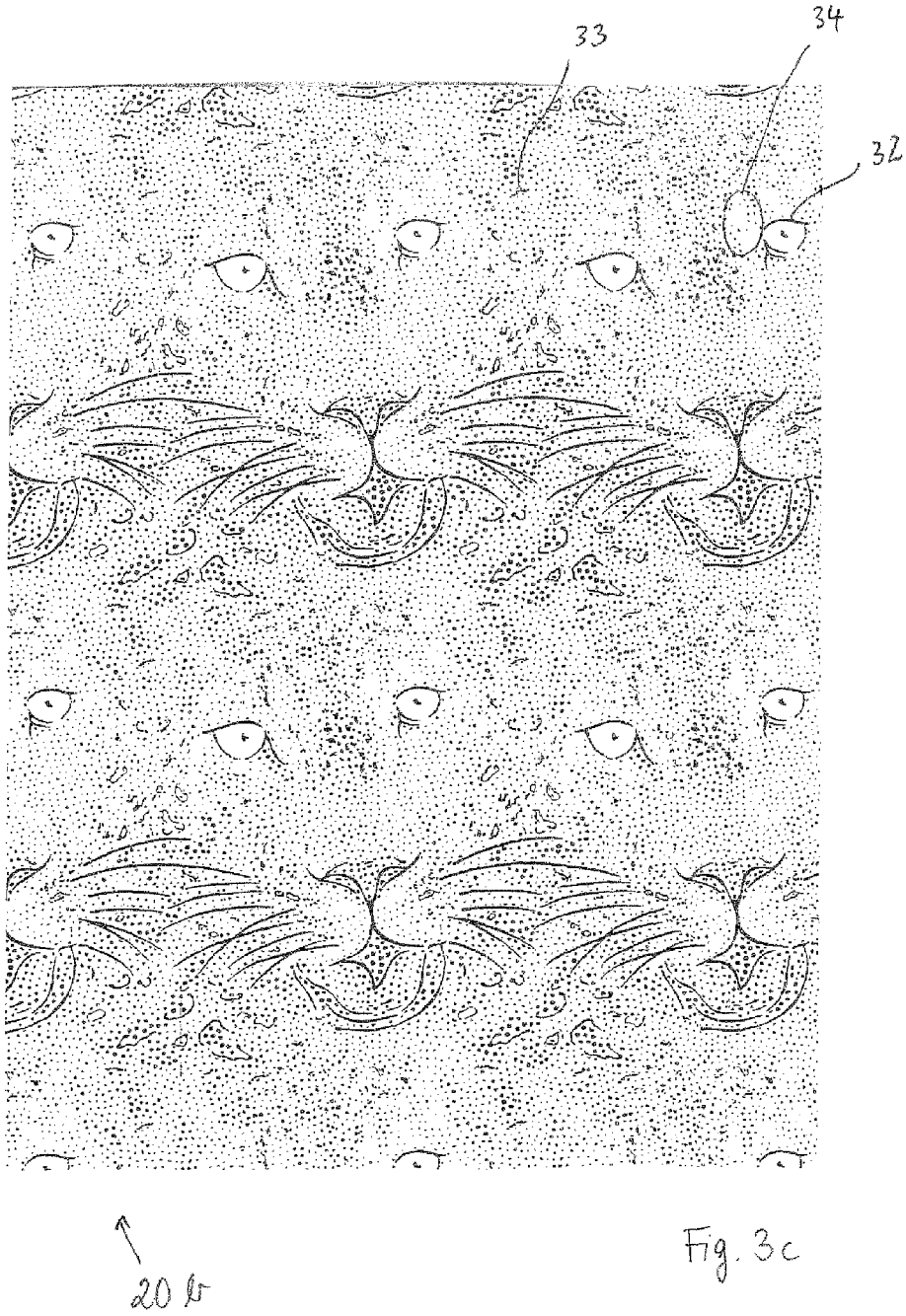
FIG. 3*c* shows another example of an embossed inventive product.

Another possibility to increase the visibility of a motive element can be seen by comparing FIGS. 2*b* and 3*c*. The motive element as shown therein is relatively similar; however, in the product 20*b*, certain parts of the motive are stressed by using embossing protrusions on the embossing roll which are elongate rips and which lead to embossed lines 32 in the rastered motive element. In addition to this, different shapes of individual embossing elements like those as shown with reference numeral 33 also being an elongate embossed element or the omission of individual embossed dots as shown in region 34 can be used. All these measures used either separately or in combination which each other can be manually applied after using an automized rastering technique and serve to improve the optical appearance of the product.

All the fibrous products 10 as shown in FIG. 2*a*, 20 as shown in FIG. 2*b*, 30 as shown in FIGS. 3*a*, 3*b* and 20*b*, as shown in FIG. 3*c* are additionally colored to increase the visibility of the example embodiments in this written document. However, the real sample also conveys a good visual representation of the motive element without the use of any additional color substances like ink or colored adhesive and only based on the shape and arrangement of the embossed protrusions.

In the following, several alternative production methods and devices will be explained.

Figure 4:
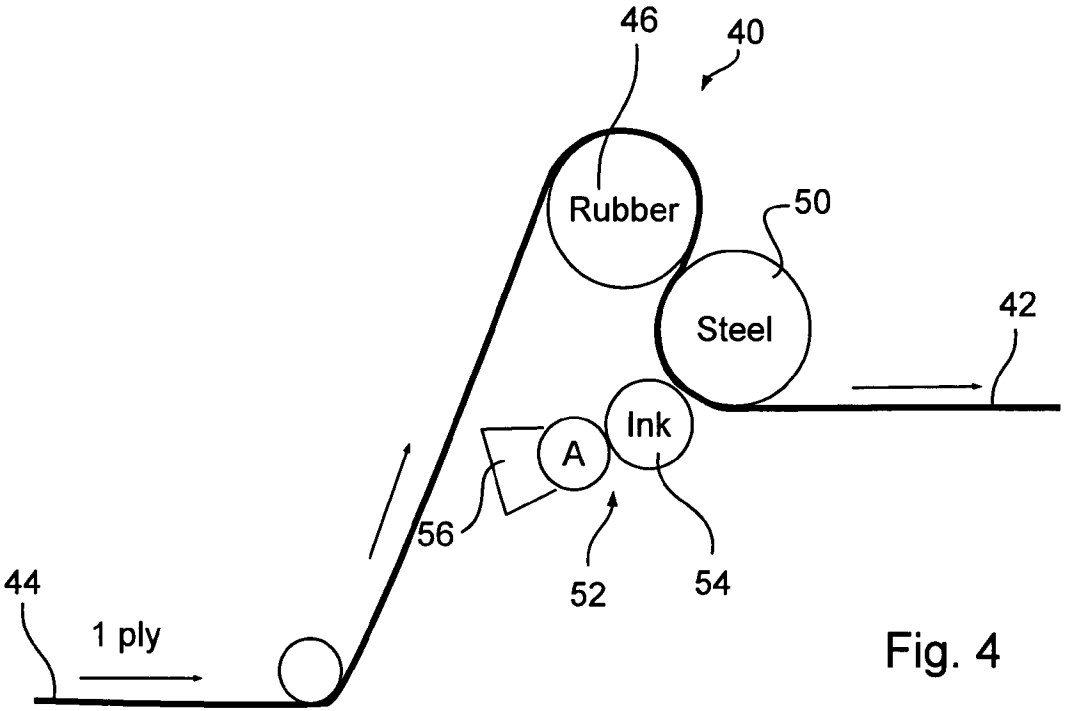
FIG. 4 schematically shows a device for producing a one-ply fibrous product according to the invention.

FIG. 4 shows a schematic view of a one-nip embossing machine 40 preferably used for a one-ply product 42. The unembossed one-ply web 44 is embossed between an embossing roll 50 according to the invention and an anvil roll 46, preferably made of rubber. In order to increase the visibility of the embossed depressions as formed in the nip between the anvil roll 46 and embossing roll 50, an ink application device 52 can be used consisting of an ink reservoir 56 and an ink application roller 54 which applies a colored substance like ink or dye towards the steel embossing roll 50 such that the product 42 is colored only in those portions in which there are embossed dots. The ink application device 52 can cover the whole width of the web or can be used only to apply color to certain, defined parts of the product. For example, it is possible to apply color only to embossed regions formed by embossing protrusions having a certain height over the base circumferential surface of the embossing roll 50 so that it can be easily differentiated between those embossed regions of the product which receive an additional coloring and those regions which do not.

Likewise it is possible to use several color application units along the longitudinal direction of the embossing roll 50, i.e. in a direction perpendicular to the drawing in FIG. 4.

After leaving the embossing device 40 according to FIG. 4, the resulting one-ply product 42 can undergo further process steps like a perforation in register with the motive element or the like (not shown here).

Figure 5:
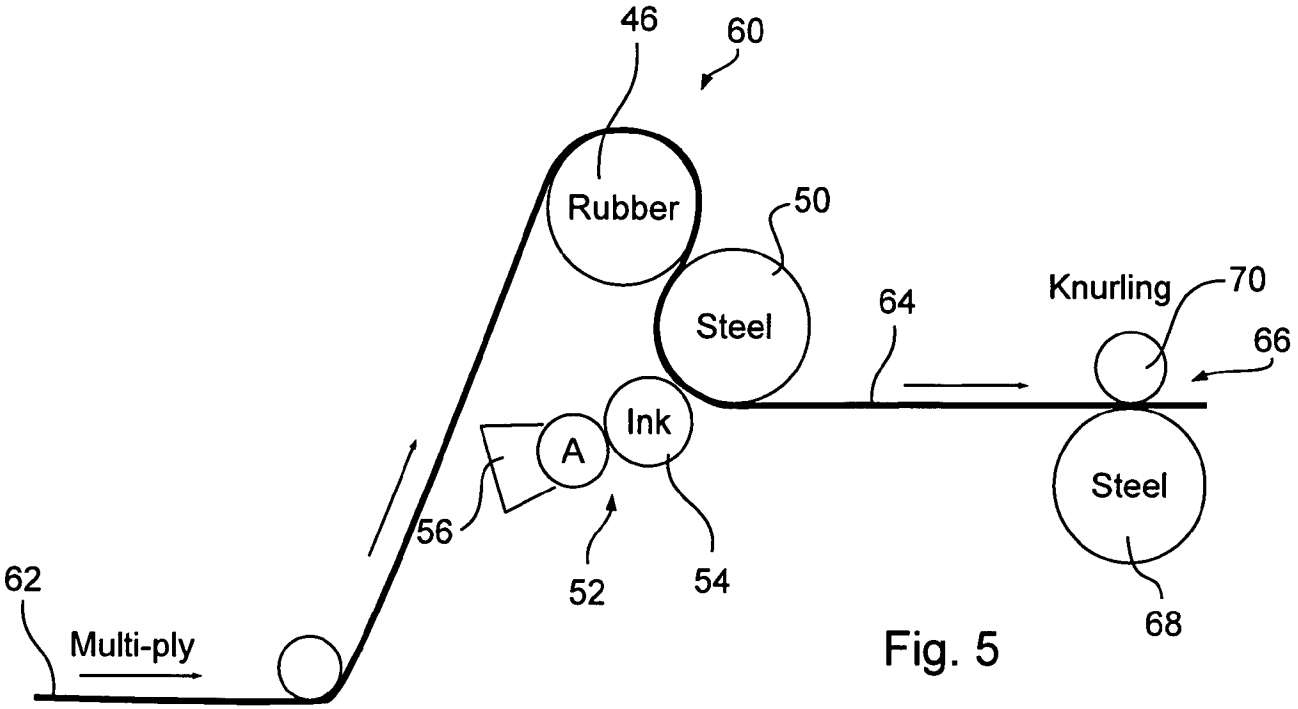
FIG. 5 depicts a schematic representation of the device for embossing and mechanical ply bonding of a multi-ply fibrous product according to the invention.

The process and device 60 as exemplified in FIG. 5 is similar to that according to FIG. 4. However, it used for a multi-ply web 62 which is embossed together in the nip between an embossing roll 50 and an anvil roll 46. Except for a possibly different positioning of the rubber anvil roll 46 and steel embossing roll 50 towards each other to take into account the thickness of the multi-ply product, the embossing of the product and the subsequent application of color in a color application unit 52 using a color application roller 54 is the same as that as explained with reference to FIG. 4. The resulting product 64 is subsequently directed into a mechanical ply bonding device 66 in which an edge embossing, like knurling, is carried out between a knurling roll 70 and a steel roll 68. However, it should be understood that the application of color is only an optional feature and that other types of mechanical ply bonding can also be used.

Figure 6:
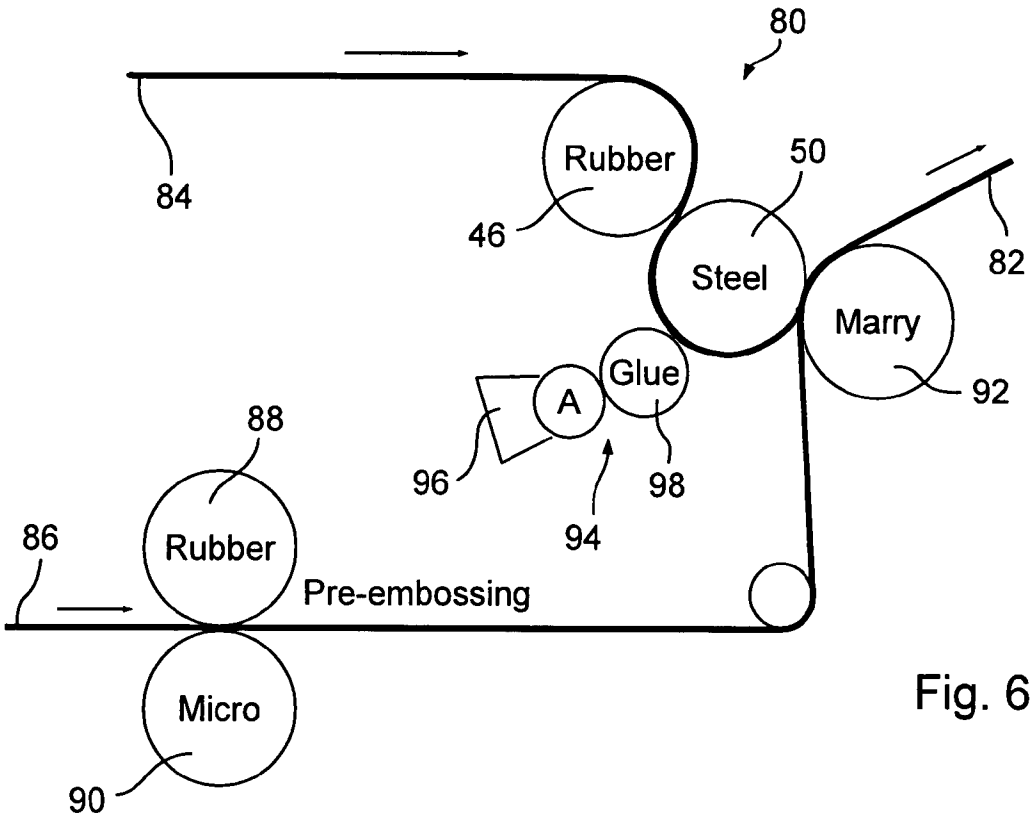
FIG. 6 shows an alternative device for the embossing and ply bonding of an inventive multi-ply fibrous product of the Goffra Incolla type.

FIG. 6 shows another type of embossing device 80 and corresponding process. The multi-ply product 82 is formed of one or more first plies 84 and one or more backside plies 86. The first ply or plies is embossed between an inventive steel embossing roll 50 and a rubber anvil roll 46, whereas the backside ply or plies is pre-embossed in the nip between a micro embossing roll 90 and a rubber anvil roll 88. After having been micro embossed, the backside ply or plies 86 are joined to the first ply or plies 84 by means of a marrying roll 92 which runs against the steel embossing roll 50. In order to achieve ply bonding, there is a glue application unit 94 consisting of an reservoir for a suitable adhesive 96 and an adhesive application roller 98. In order to increase the visibility of the product, the adhesive applied in the application roller 98 can be colored. The lamination between the first ply or plies and backside ply or plies is done with the steel embossing roll 50.

For registering, a technology can be used which is described in WO2006/099881 and relates to the providing, in the area of an embossing station, at least one mark onto the web of material which is in register to the embossed pattern. This mark is sensed in order to control a perforating device for registering the perforation lines with the embossed pattern so that perforation lines are imparted to the continuous product in predetermined longitudinal distances. This technique for registering can likewise be used in the processes and devices as described in FIGS. 4 to 7.

Figure 7:
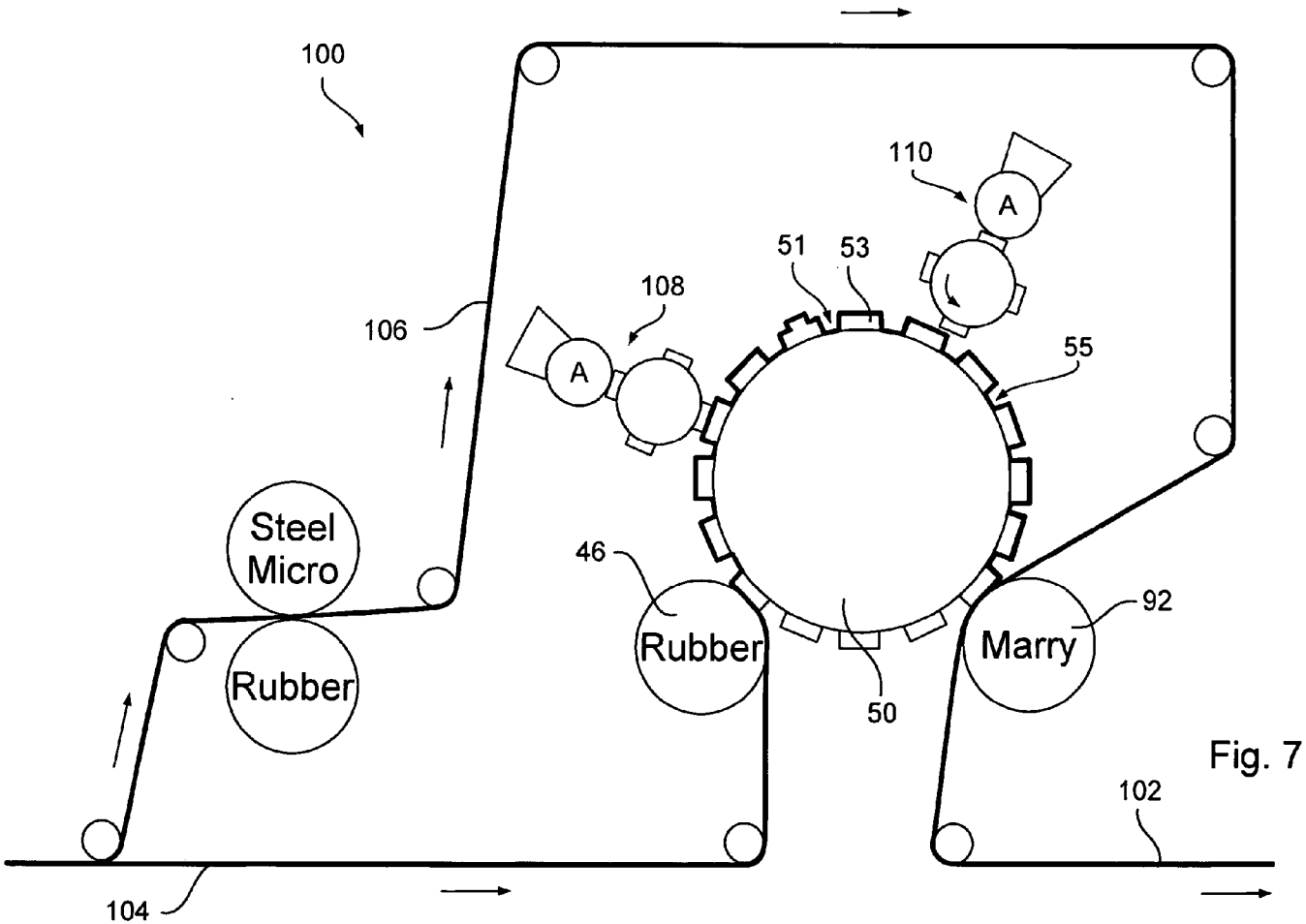
FIG. 7 shows another embossing device of the CI (Central Impression) type (see WO2007/064327) for an inventive multi-ply fibrous product.

FIG. 7 shows another device 100 for producing a multi-ply inventive fibrous product and schematically shows the major parts of the device and process as used. The resulting product 102 is formed of at least one first ply 104 and at least one backside ply 106 which continuously run through the device 100. The at least one first ply is embossed between the inventive steel embossing roll 50 and the rubber anvil roll 46. The embossing roll 51 has embossing protrusions 53 on its embossing surface 51. There are additional embossing protrusions 51 having a lower height over the base circumferential surface 51 than embossing protrusions 53. Following the embossing step, two application devices 108, 110 for colored substances are shown. This creates a multi-coloured embossing. The embossed and optionally colored at least one first ply 104 is combined with the at least one backside ply 106 in the nip between a marrying roll 92 and the steel embossing roll 50. Downstream of the marrying roll, the combined multi-ply product can undergo further treatment like perforations or cuttings in register with the motive element or additional coloring steps (not shown here).

By use of the embossing roll as described above, a complete new optical appearance of the resulting product becomes possible. No matter whether the embossed fibrous product is a one ply or multi-ply product, the embossing consists of a plurality of dots which together represent a design.

The shape of the embossing dots is preferably round. However, elliptical, square, rectangle embossing dots are also possible. In addition to this and as shown in FIG. 3*c*, lines can be used. Even a combination of dots of different shapes and heights and lines is possible so that the shape of the embossing dots can also be used to represent certain colors. For example it is possible to use small round dots for light colors and square dots for intensive colors.

The invention claimed is:

1. A fibrous product selected from the group consisting of tissue paper product, non-woven product and a hybrid thereof, comprising:

at least one first ply with at least one embossing pattern comprising embossed depressions starting from a base plane of the ply;

the embossing pattern being characterized by the following features: the embossing pattern has a minimum motive surface area of at least 3 cm×3 cm;

the embossing pattern comprises at least 300 embossed depressions of at least twenty different sizes in a 3 cm×3 cm area of the motive surface area which are sized and/or positioned such as to form a coherent rastered motive element covering the motive surface area thus forming an amplitude modulated raster or a frequency modulated raster of a hybrid thereof;

wherein at least some of the embossed depressions are sized and/or positioned such that minimum distances between pairs of consecutively arranged embossed depression vary.

2. The fibrous product according to claim 1, wherein the individual embossed depressions are dots having a cross-sectional shape which is essentially circular or essentially elliptical or essentially square-shaped; and which are arranged regularly and form a regular raster but with varying heights and/or sizes of the individual dots or which are arranged in a random manner and have the same sizes.

3. The fibrous product according to claim 1, wherein the individual embossed depressions are essentially circular dots forming first regions, in which the dots are arranged regularly to form a raster, wherein the dots within the first regions do not all have the same heights and/or sizes, and second regions in which the dots are arranged in a random manner.

4. The fibrous product according to claim 2, further comprising second embossed depressions having an essentially linear shape.

5. The fibrous product according to claim 1, wherein the fibrous product comprises at least one further ply forming a backside ply, which is unembossed or has the same embossing pattern as the first ply, or which is embossed with a second embossing pattern different from the embossing pattern of the first ply, the second embossing pattern comprising a micro-embossing pattern.

6. The fibrous product according to claim 5, wherein the first ply and the backside ply are bonded together at least at some of the tips of the embossed depressions of the plies facing each other.

7. The fibrous product according to claim 5, further comprising at least one middle ply between the first ply and the backside ply, which is volume embossed.

8. The fibrous product according to claim 7, comprising four plies, the middle ply adjacent to the first ply being embossed together with the first ply.

9. The fibrous product according to claim 1, wherein at least some of the embossed depressions are colored with ink or colored adhesive.

10. The fibrous product according to claim 1, being a rolled product and comprising perforations or being a single sheet being folded and/or stacked.

11. The fibrous product according to claim 5, having two plies, wherein the embossing patterns of the first ply and the backside ply are arranged such that they are nested into each other.

12. The fibrous product according to claim 1, being a rolled product and comprising perforations wherein the motive elements are in register with individual sheets delimited by the perforations.

13. A method for producing a fibrous product selected from the group consisting of tissue paper product, non-woven product and a hybrid thereof, comprising:

(a) directing a single-ply first ply or multi-ply first ply into a nip between an embossing roll and an anvil roll, wherein the embossing roll has embossing protrusions such that they form at least one pattern with a base surface area of at least 3 cm×cm;

within the at least one pattern there is at least 300 embossing protrusions of at least twenty different sizes in a 3 cm×3 cm area of the base surface area which are sized and/or positioned such as to represent a coherent rastered motive element covering the base surface area thus forming an amplitude modulated raster or a frequency modulated raster of a hybrid thereof; and wherein at least some of the embossing protrusions are dimensioned and/or positioned such that consecutive minimum distances between opposed side surfaces of pairs of embossing protrusions arranged in sequence vary gradually.

14. The method according to claim 13, further comprising after step (a): (b) applying ink or a colored adhesive, towards the embossing protrusions of the embossing roll.

15. The method according to claim 14, further comprising at least one backside ply, and further comprising the method steps:

(c) combining the first ply or first plies and the at least one backside ply in the nip between the embossing roll and a marrying roll; and (d) embossing the at least one backside ply in the nip between a second embossing roll and a second anvil roll.

16. The method according to claim 15, further comprising the step of (e) applying adhesive to the embossed protrusions of the first ply or first plies before carrying out method step (c), wherein the adhesive is colored.

17. The method according to claim 15, further comprising, instead of step (c):

(c1) mechanically ply bonding at least some of the plies by edge embossing or knurling.

18. The method according to claim 15, wherein the first ply or the first plies and the at least one backside ply are combined in a nested arrangement.

19. The method according to claim 15, comprising instead of step (c) the step of (c2) combining the first ply or first plies and the at least one backside ply between the embossing roll and a second embossing roll, in a pin-to-pin arrangement.

20. The method according to claim 13, further comprising the step of (b1) applying different colored substances to define parts of the first ply or first plies, on a side which is directed to the at least one backside ply in the finished product.

* * * * *